US006202216B1

(12) United States Patent
Watanabe et al.

(10) Patent No.: US 6,202,216 B1
(45) Date of Patent: Mar. 20, 2001

(54) GARMENT

(75) Inventors: Hidetoshi Watanabe, Tokyo; Toshinori Nishimura, Hiratsuka, both of (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 09/243,443

(22) Filed: Feb. 3, 1999

(30) Foreign Application Priority Data

Feb. 4, 1998 (JP) ..... 10-023118

(51) Int. Cl.[7] ..... A41B 1/08
(52) U.S. Cl. ..... 2/125; 2/243.1
(58) Field of Search ..... 2/90, 106, 113, 2/115, 125, 243.1

(56) References Cited

U.S. PATENT DOCUMENTS 2,399,428 * 4/1946 Daniels ..... 2/90
2,659,890 * 11/1953 Revolta ..... 2/90
2,836,826 * 6/1958 Geiss ..... 2/90
2,860,345 * 11/1958 Johnson ..... 2/90
3,078,699 * 2/1963 Huntley ..... 2/106
3,719,956 * 3/1973 Glassberg ..... 2/125
5,608,913 * 3/1997 Lacoste ..... 2/115

* cited by examiner

*Primary Examiner*—Bibhu Mohanty
(74) *Attorney, Agent, or Firm*—Finnegan, Henderson, Farabow, Garrett & Dunner, L.L.P.

(57) ABSTRACT

Disclosed is a garment which comprises front and rear body of a garment, arm holes formed in upper parts of both left and right side lines where the front and rear body of the garment are stitched together, sleeve sections fixed to the arm holes, protruded sections formed in upper parts of both side lines so as to be united with the front and rear body of the garment, where parts of the front and rear body of the garment are extended to centers of the arm holes, and slack sections formed in portions where protruded sections and parts of the sleeve sections under arms are stitched together.

4 Claims, 5 Drawing Sheets

GARMENT

BACKGROUND OF THE INVENTION

The present invention relates to a garment. More specifically, the invention relates to a garment which is suitably used especially as a sports wear jacket such as golf wear.

If an arm is raised or an upper half of a body is largely twisted while the arm is swung with a garment such as golf wear on, a large resistance may be felt in a part under the arm. In an extreme case, a bottom portion of a jacket was pulled to be exposed from trousers, which led to inconvenient disorder of the garment.

Such inconvenience may be attributed to a shape of a portion for connecting a body of a garment and a sleeve section of the jacket with each other. In other words, such a problem may be caused by a deviation in fulcrums of motion in upper and lower directions between the arm and the jacket while the arm is raised.

A fulcrum of motion of an arm for an upper part of the body is located roughly in the center of an arm hole of the garment. But a fulcrum of motion of the garment is located in a part under the arm. Such a difference in fulcrums of motion between the two may produce a feeling of resistance, i.e., pulling of a garment material in the body of a garment, when the arm is raised or the upper half of the body is twisted while the arm is swung.

For providing a jacket which enables a smooth movement to be made without any feelings of resistance, i.e., pulling of a garment material in the body of a garment like that described above, a material having high stretchability may be employed. Alternatively, an unsewn (seamless) structure made of one sheet of cloth may be utilized.

However, if a garment is made of a material having high stretchability, it is uncomfortable to wear because the garment material sticks to a body. If a garment has an unsewn structure made of one sheet of cloth, shape crumbling easily occurs. In addition, application of the material having high stretchability to general garments is limited, because it can only be used for special purposes.

SUMMARY OF THE INVENTION

It is an object of the present invention to provide a garment which enables a smooth movement to be made with only a limited feeling of resistance, i.e., pulling of its material in a part under an arm, when the arm is raised or an upper part of a body is twisted while the arm is swung. It is another object of the invention to provide a garment which is suitably used as sports wear such as golf wear.

In order to achieve the foregoing object, a garment of the present invention comprises: a front body of a garment; a rear body of a garment; arm holes formed in upper parts of both left and right side lines, where the front and rear body of a garment are stitched together; sleeve sections fixed to the arm holes; protruded sections formed in upper parts of both side lines so as to be united with the front and rear body of a garment, where parts of the front and rear body of a garment are extended to centers of the arm holes; and slack sections formed in portions where the protruded sections and parts of the sleeve sections under arms are stitched together.

As described above, according to the present invention, the protruded sections are formed in the upper parts of the side lines under the arms where the front and rear body of a garments are stitched together, the protruded sections being united with the front and rear body of a garments, and the slack sections are formed in the portions stitched to sleeve fixing sections of the sleeve sections. Accordingly, when the arm is raised or an upper part of a body is twisted while the arm is swung, a difference in fulcrums of motion between the arm and the sleeve section is absorbed by each of the slack sections, and thereby a feeling of resistance, i.e., pulling of a garment material in a part under the arm, can be prevented.

BRIEF DESCRIPTION OF THE DRAWINGS

For a more complete understanding of the present invention and the advantages thereof, reference is now made to the following description taken in conjunction with the accompanying drawings.

DETAILED DESCRIPTION OF THE PREFERRED EMBODIMENT

Figure 1:
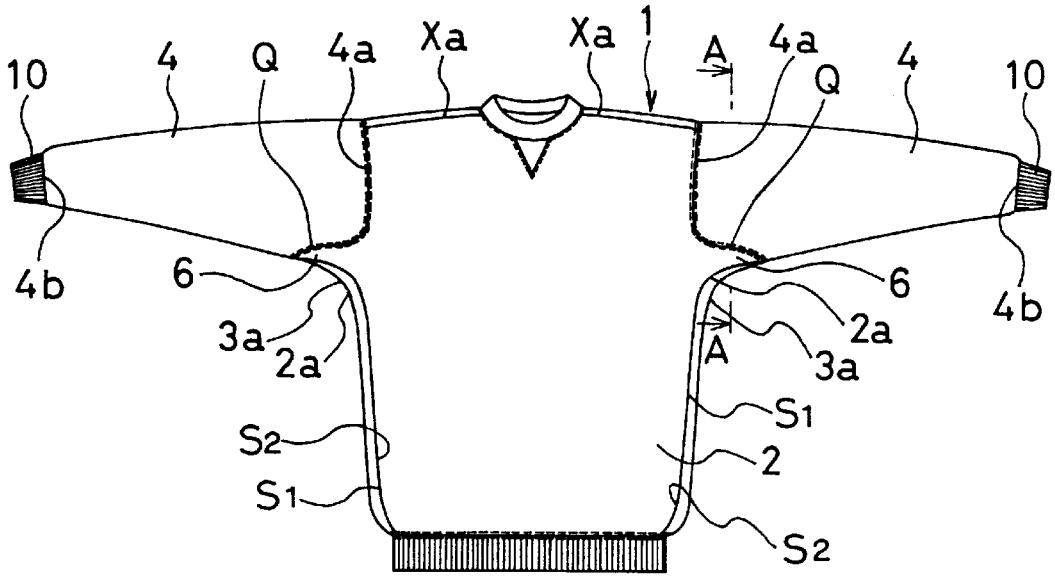
FIG. 1 is a front view showing golf wear of an embodiment of the present invention.
Figure 2:
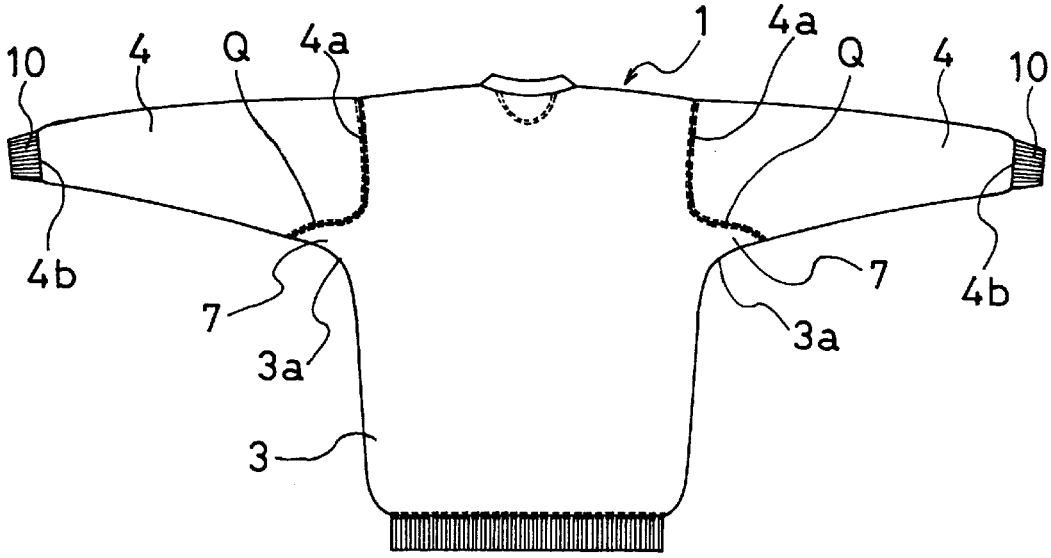
FIG. 2 is a rear view of the golf wear of FIG. 1.
Figure 3:
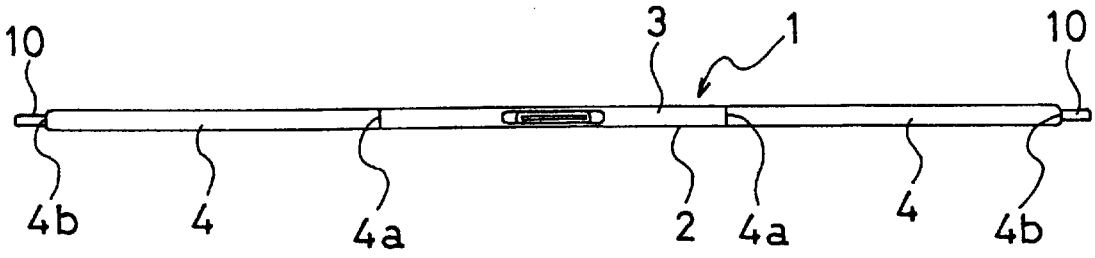
FIG. 3 is a top view of the golf wear of FIG. 1.
Figure 4:
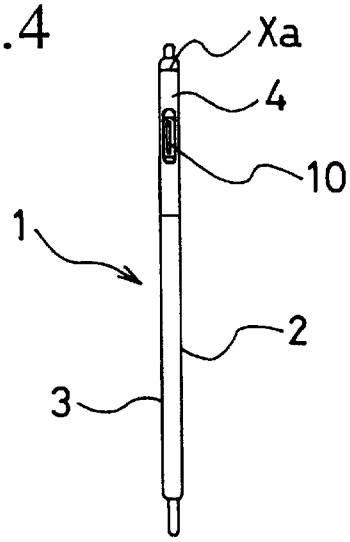
FIG. 4 is a left side view of the golf wear of FIG. 1.
Figure 5:
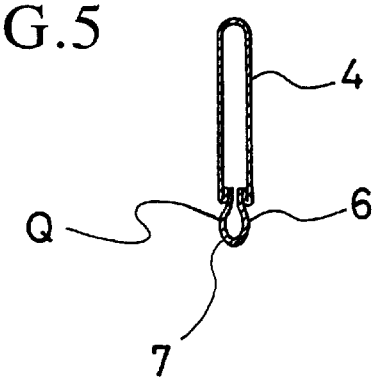
FIG. 5 is a sectional view taken along the line A—A of FIG. 1 when viewed from the arrow.

Referring to each of FIGS. 1 to 5, shown is golf wear of an embodiment of the present invention. In the drawings, a garment 1 comprises a front body of a garment 2, a rear body of a garment 3 cut to have an area slightly larger than that of the front body of a garment 2 and left and right sleeve sections 4. These sections are stitched together.

Figure 6:
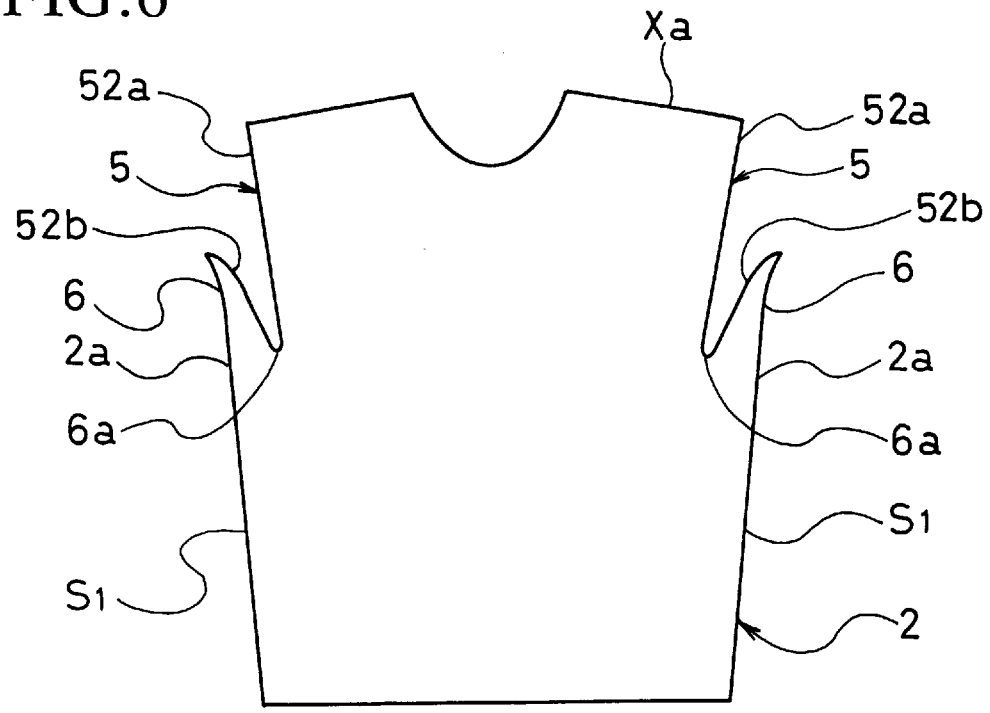
FIG. 6 is a front view of a front body of a garment of a cut piece before sewing up the golf wear of FIG. 1.
Figure 7:
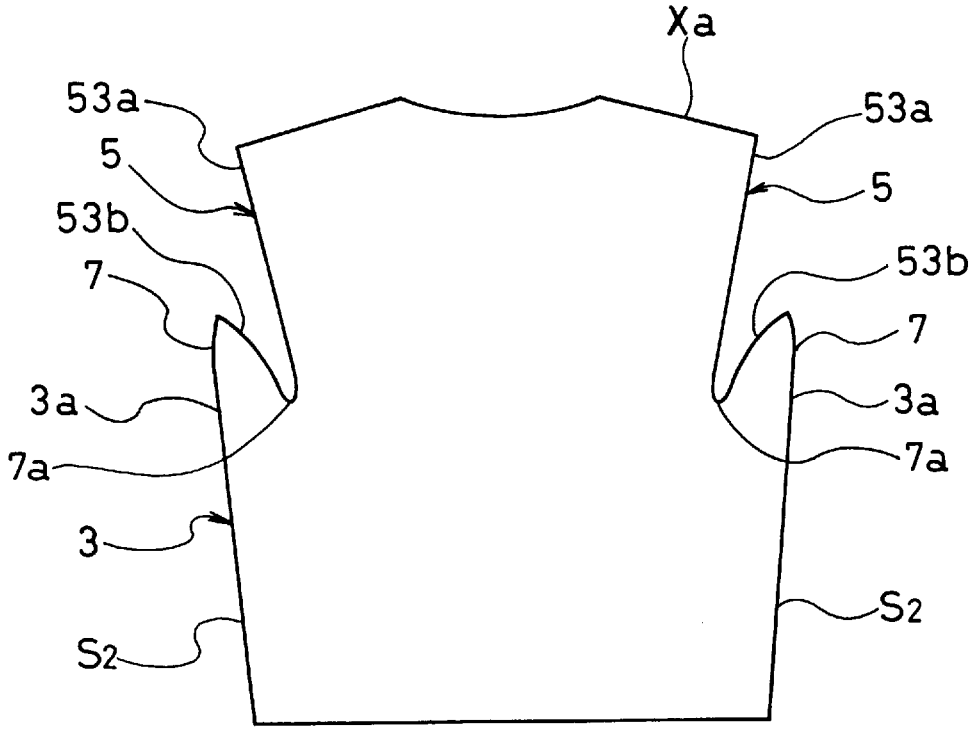
FIG. 7 is a front view of a rear body of a garment of a cut piece before sewing up the golf wear of FIG. 1.
Figure 8:
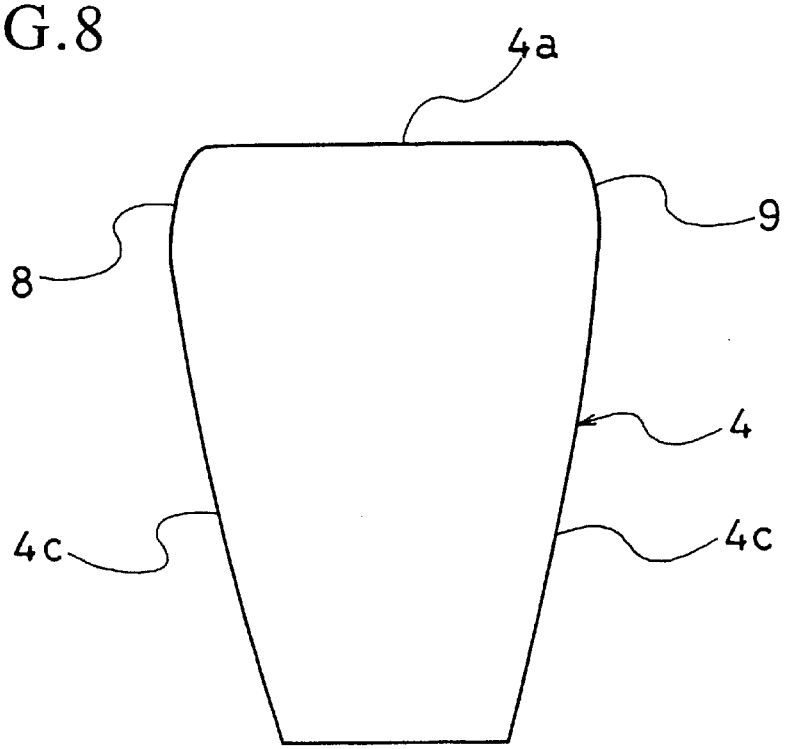
FIG. 8 is a development view of a sleeve section of a cut piece before sewing up the golf wear of FIG. 1.

In the front and rear body of a garment 2 and 3 of cut pieces before sewing up, protruded sections 6 and 7 like those shown in FIGS. 6 and 7 are respectively provided in portions where parts 2*a* and 3*a* under an arm and an arm hole 5 meet each other, the parts 2*a* and 3*a* being upper parts of side lines $S_1$ and $S_2$. In each of cut pieces of the left and right sleeve sections 4, as shown in FIG. 8, cut-off parts 8 and 9 are formed in both left and right sides of a sleeve fixing section 4*a*. The sleeve fixing section 4*a* is a place to be stitched to a line 52*a* of the arm hole 5 of the front body of a garment 2 and a line 53*a* of the rear body of a garment 3. The cut-off parts 8 and 9 are places to be respectively stitched to lines 52*b* and 53*b* of the arm hole 5 in the sides of the protruded sections 6 and 7.

The front and rear body of a garments 2 and 3 cut in the foregoing manner are stitched together at both side lines $S_1$ and S2 and at shoulder sections Xa. The sleeve section 4 is formed to be cylindrical by stitching both side lines 4*c* and 4*c* to each other. The sleeve fixing section 4*a* of this sleeve section 4 is stitched to the line 52*a* of the front body of a garment 2 and the line 53*a* of the rear body of a garment 3, and the cut-off parts 8 and 9 are stitched to the lines 52*b* and 53*b*. Thereby, the garment 1 is constructed. A slack section 0 is formed in a portion where the arm hole lines 52*b* and

53*b* of the protruded sections 6 and 7 and the cut-off parts 8 and 9 are stitched together.

When the garment 1 sewn up in the foregoing manner is put on and the arm is raised or an upper part of a body is twisted while the arm is swung, the slack section Q is stretched and thus a garment material of the front body of a garment 2 or the rear body of a garment 3 in a part under the arm is prevented from being pulled. Accordingly, the arm can be smoothly moved without any feelings of resistance.

In other words, when the arm is raised or the upper part of the body is twisted while the arm is swung, a position of the garment 1 as a fulcrum of motion is transferred to the slack section Q where the protruded sections 6 and 7 and the cut-off parts 8 and 9 are connected together. Accordingly, a smooth movement of the arm can be permitted without pulling the garment material of the front body of a garment 2 or the rear body of a garment 3 in the part under the arm.

Figure 9:
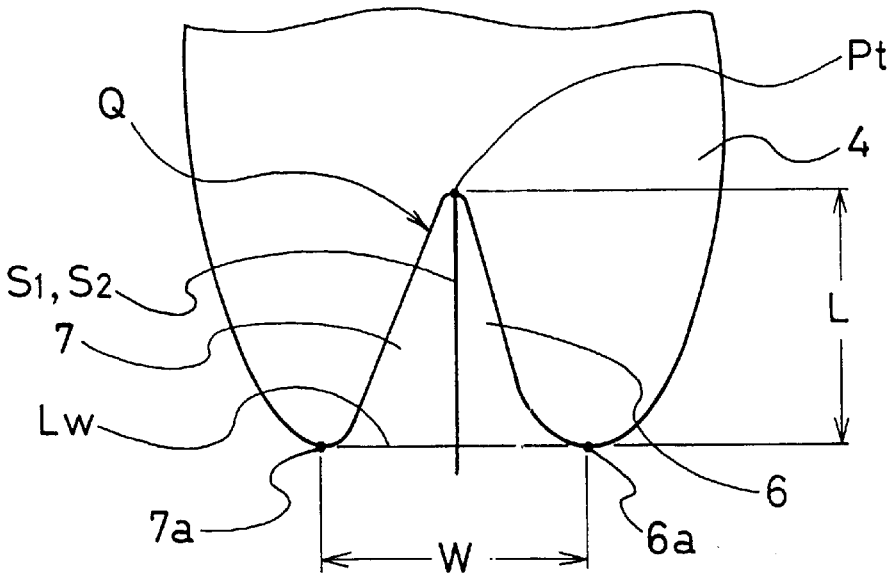
FIG. 9 is a view showing a state where a protruded section of the golf wear of FIG. 1 is developed on a plane.
Figure 10:
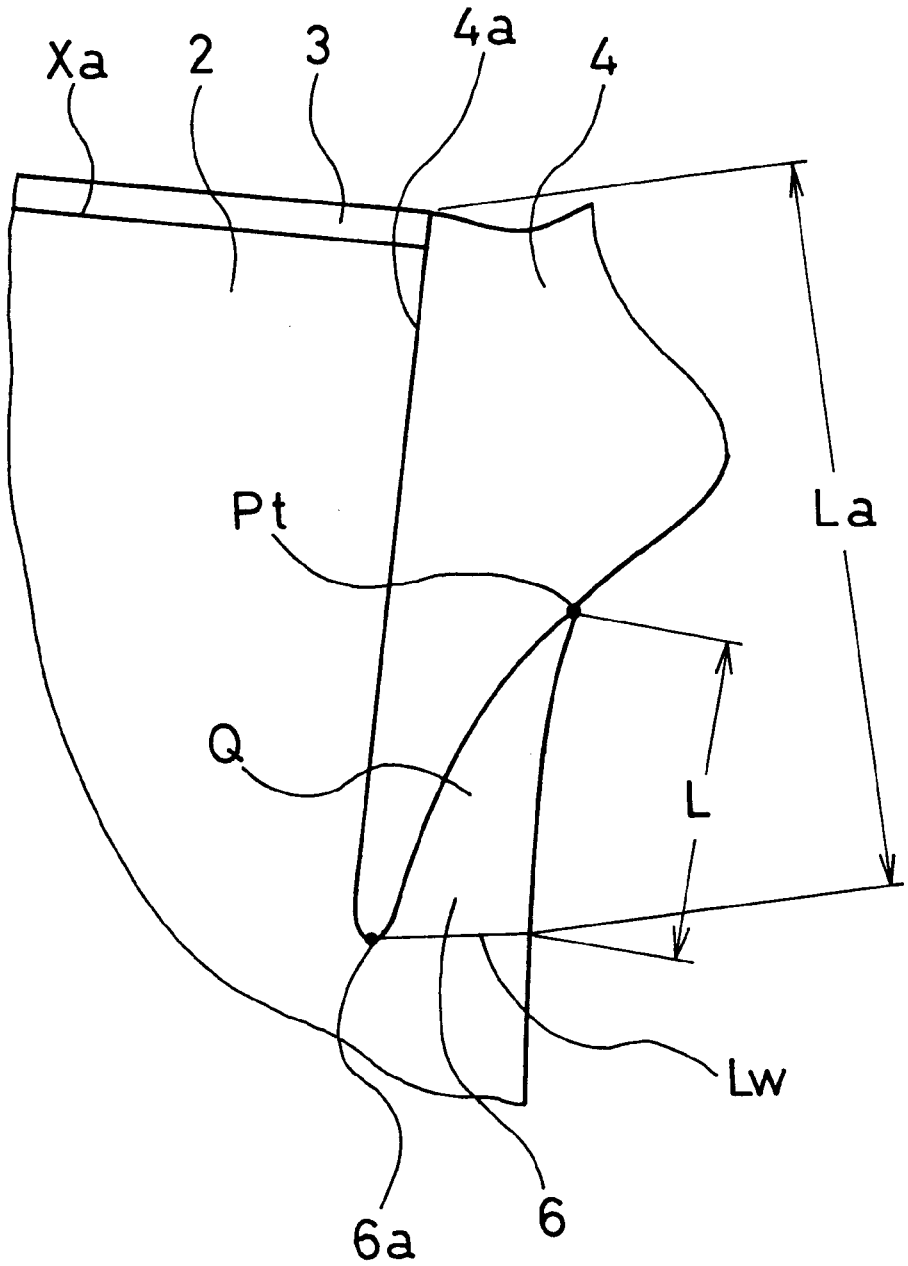
FIG. 10 is a view showing a state where the protruded section of the golf wear of FIG. 1 is folded at a side line.

According to the present invention, a width W between rising base parts 6*a* and 7*a* of the protruded sections 6 and 7 which are stitched to each other depends on a size of the garment 1. This width W should preferably be set in a range of 7 cm to 16 cm when the protruded sections are developed on a plane as shown in FIG. 9. The base parts 6*a* and 7*a* described herein are respectively equivalent to points of inversion of the lines 52*a* and 53*a* of the arm hole 5 to the lines 52*b* and 53*b*.

A length L from a line part Lw for connecting the base parts 6*a* and 7*a* to each other to an apex Pt made by the protruded sections 6 and 7 should preferably be set in a range of 1/10 to 1/2 or, more preferably, 1/5 to 2/5 of a sleeve fixing width La.

If the width W between the base parts 6*a* and 7*a* of the protruded sections 6 and 7 and L/La are too large, the slack section Q will be enlarged. Consequently, the garment will be uncomfortable to wear. If the width W between the base parts 6*a* and 7*a* and L/La are small and the slack section Q becomes too small, the garment material in the part under the arm will be pulled when the arm is raised or the like. Consequently, the effects of the present invention will be lost.

According to the present invention, preferably the rear body part of the garment has a slightly larger area than the front body part, but it is also possible that the rear body part is so cut as to have a same area as the front body part or a smaller area than the front body part.

The protruded sections 6 and 7 should preferably be formed to be roughly triangular in shape like those shown in the embodiment. But other shapes can be used, for example a polygon more than a square or a combination of circular arcs.

The garment of the present invention is suitably used as sports wear such as golf wear. But it can also be used as general wear such as a shirt or blouson.

As described above, the garment of the present invention comprises the protruded sections in the part under the arm at the side lines for stitching the front and rear body of a garment to each other, the protruded sections being formed so as to be united with the front and rear body of a garments and extended to the center side of the arm hole, and the slack section formed in the part under the arm. Accordingly, when the arm is raised or the upper part of the body is twisted while the arm is swung, a smooth movement can be made without any feelings of resistance, i.e., pulling of the garment material in the part under the arm. Moreover, since the protruded sections are formed so as to be united with the front and rear body of a garments, the garment can be manufactured simply and at low costs.

Although the preferred embodiment of the present invention has been described in detail, it should be understood that various changes, substitutions and alternations can be therein without departing from spirit and scope of the invention as defined by the appended claims.

What is claimed is:

1. A garment comprising:

a front body of a garment;

a rear body of a garment;

arm holes formed in upper parts of both left and right side lines where said front and rear body of a garment are stitched together;

sleeve sections fixed to said arm holes;

protruded sections formed in upper parts of both of said side lines that are integral with said front and rear body of a garment and that extend to centers of said arm holes; and slack portions where said protruded sections and underarm parts of said sleeve sections are stitched together, wherein a length of an imaginary line connecting base parts of said protruded sections to each other to an apex of the protruded sections is set in a range of 1/10 to 1/2 of a sleeve fixing width.

2. A garment according to claim 1, wherein a width between the base parts of said protruded sections is set in a range of 7 cm to 16 cm.

3. A garment according to claim 1, said garment being used as sports wear.

4. A garment according to claim 3, wherein said sports wear is golf wear.

* * * * *